US005196864A

United States Patent [19]

Caine

[11] Patent Number: 5,196,864

[45] Date of Patent: Mar. 23, 1993

[54] ELECTRONIC REGISTRATION IN A MULTIPLE PRINTHEAD THERMAL PRINTER

[75] Inventor: Holden R. Caine, Albany, N.Y.

[73] Assignee: Eastman Kodak Company, Rochester, N.Y.

[21] Appl. No.: 744,031

[22] Filed: Aug. 12, 1991

[51] Int. Cl.[5] ..... B41J 2/325

[52] U.S. Cl. ..... 346/76 PH

[58] Field of Search ..... 346/76 PH, 134; 400/120 MC, 82

[56] References Cited

U.S. PATENT DOCUMENTS

| | | | |
|---|---|---|---|
| 4,394,092 | 7/1983 | Osmera et al. | 400/120 |
| 4,415,908 | 11/1983 | Sugiura | 346/76 PH |
| 4,540,991 | 9/1985 | Kariya et al. | 346/76 PH |
| 4,554,559 | 11/1985 | Heath | 346/76 PH |
| 4,652,155 | 3/1987 | Hakoyama et al. | 400/120 |
| 4,663,636 | 5/1987 | Ohnishi et al. | 346/76 PH |
| 4,663,734 | 5/1987 | Berry | 364/900 |
| 4,740,802 | 4/1988 | Stuckey-Kauffmann et al. | 346/157 |
| 4,748,455 | 5/1988 | Mori | 346/76 PH |
| 4,779,102 | 10/1988 | Sasaki | 346/76 PH |
| 4,789,870 | 12/1988 | Lacord et al. | 346/1.1 |
| 4,804,979 | 2/1989 | Kamas et al. | 346/157 |

FOREIGN PATENT DOCUMENTS

| | | | |
|---|---|---|---|
| 3737449 | 5/1988 | Fed. Rep. of Germany MC | 400/120 |
| 0083864 | 5/1985 | Japan | 400/120 MC |
| 0072564 | 4/1988 | Japan | 400/120 MC |

*Primary Examiner*—Benjamin R. Fuller
*Assistant Examiner*—N. Le
*Attorney, Agent, or Firm*—Raymond L. Owens

[57] ABSTRACT

A multiple printhead thermal printer has a receiver and a print drum supporting the receiver as dye is thermally transferred to the receiver during printing. Electronic circuitry controls registration of the receiver during printing so that the color separations are aligned to produce a clear, crisp image. This registration is achieved by introducing line delays to receive the image data prior to the image data reaching the modulators which process the image data for the second and third printheads. The position of the image produced by a thermal printhead along the print direction is determined by when data is sent to the printhead. Delaying the printing of a line by some fraction of a line time proportionally repositions the print line by a fraction of a line.

15 Claims, 4 Drawing Sheets

ELECTRONIC REGISTRATION IN A MULTIPLE PRINTHEAD THERMAL PRINTER

FIELD OF THE INVENTION

This invention relates generally to thermal printers and, more particularly, relates to registration or adjustment of the print between printheads in a multiple printhead continuous tone thermal printer.

BACKGROUND OF THE INVENTION

Color thermal printers may be of the single printhead variety or may be of a multiple printhead variety. In a single printhead color thermal printer, the color dyes, yellow, magenta and cyan, are applied to the receiver one at a time so that three applications are required to obtain a color print. A multiple printhead color thermal printer has the advantage of simultaneously applying dye to three separate areas of the receiver thereby printing three images at one time. A multiple printhead thermal printer prints all required color separations in a continuous motion by transporting the receiver sheet past a series of printheads.

A problem with multihead color thermal printing is the difficulty of properly aligning the color separations on the receiver to give crisp, high quality images. Even when the printheads are accurately positioned relative to the print drum or to the receiver pathway, there still exists the possibility for poor registration which deteriorates print quality. There is a possibility for misregistration in the direction of travel of the receiver because the receiver may stretch or become misaligned on the drum. Also, when the receiver web is misaligned or skewed on the drum, the sideways orientation is affected. It will be appreciated that it would be highly desirable to have a multiple printhead color thermal printer which produces a high quality color print with excellent registration.

Although the printheads may be accurately positioned and precisely aligned relative to the print drum or to the receiver pathway, mechanical adjustments are impractical, if not impossible, during operation of a thermal printer. Without the ability to adjust the print process electronically, accurate printhead position is required during operation, both along the receiver path and side to side across the receiver path to ensure exact print registration between images from each printhead. Accordingly, it will be appreciated that it would be highly desirable to have a thermal printer which employs electronic print devices and circuitry to ensure exact registration between images from each printhead.

SUMMARY OF THE INVENTION

The present invention is directed to overcoming one or more of the problems set forth above. Briefly summarized, according to one aspect of the present invention, a thermal printer has a receiver and a print drum supporting the receiver as dye is thermally transferred to the receiver during printing. There are multiple printheads positioned about the print drum for controllably transferring dye to the receiver. Means are provided for controlling registration of the receiver during travel of the receiver between the printheads.

An object of the present invention is to provide registration for a multiple printhead color thermal printer so that the color separations are aligned to produce a clear, crisp image. This object is achieved by introducing line delays to receive the image data prior to the image data reaching the modulators which process the image data for the second and third printheads. More accurate position adjustment is possible when the start of line timing of each modulator circuit is controlled relative to the first printhead. The position of the image produced by a thermal printhead along the print direction is determined by when data is sent to the printhead. By delaying the printing of a line by some fraction of a line time, the image can be proportionally repositioned by a fraction of a line.

With the present invention, the print position along the print path taken by the receiver is easily adjusted by controlling the timing of the data to the printhead modulation circuitry. The modulators typically processes a line of image data at a time so that the smallest position adjustment is to the nearest line.

According to another aspect of the invention, means are provided for laterally effecting the start of printing of the printheads so that the printheads begin printing at a preselected location along the width of the receiver.

These and other aspects, objects, features and advantages of the present invention will be more clearly understood and appreciated from a review of the following detailed description of the preferred embodiments and appended claims, and by reference to the accompanying drawings.

DETAILED DESCRIPTION OF THE PREFERRED EMBODIMENTS

Figure 1:
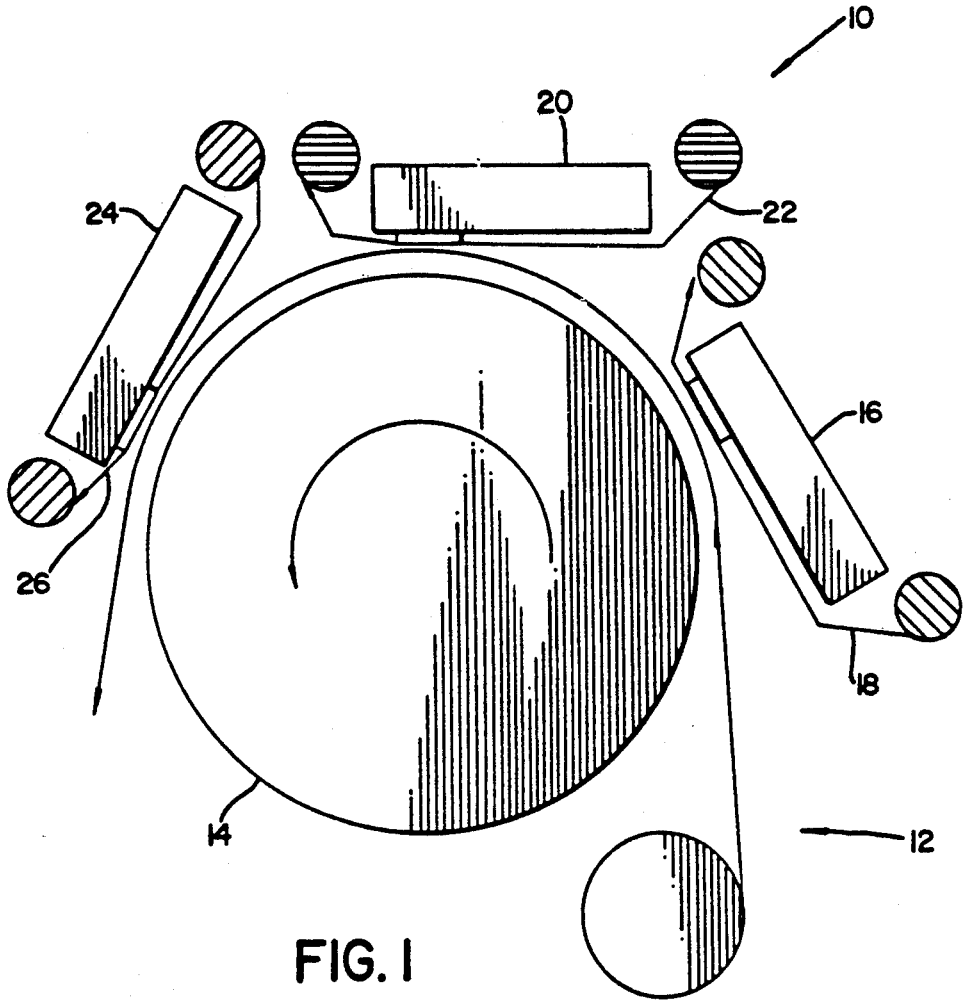
FIG. 1 is a diagrammatic side view of a preferred embodiment of a thermal printer incorporating multiple printheads and a receiver web in accordance with the present invention.

Referring now to the drawings, in which like numerals indicate like elements throughout the several figures. FIG. 1 is a simplified diagrammatic side view of the multiple printhead thermal printer. The thermal printer 10 includes a receiver 12 and a print platform or drum 14 that supports the receiver 12 as dye is transferred to the receiver 12. Positioned about the drum 14 is a first printhead 16 that has a dye bearing donor web 18 positioned in proximity to the print drum 14 for controllably transferring dye to the receiver 12. As is well known in the art, the printhead 16 may be moved to a print position wherein the receiver 12 rests against the drum 14. At the print position, the printhead 16 is close enough to the drum 14 so that dye is thermally transferred from the donor web 18 to the receiver 12 when the printhead 16 is heated.

Also positioned about the drum 14 is a second printhead 20 which has its own donor supply web 22. The printhead 20 and the donor web 22 are similar to the first printhead 16 and its associated donor web 18 except that it is positioned at a different location. Similarly, the third printhead 24 and its associated donor web 26 are positioned about the drum 14 as are the first printhead 16 and second printhead 20.

In their respective printing positions the printheads 16, 20, 24 are spaced preselected distances one from the other. Ideally, the distance from the second printhead 20 to the first printhead 16 is the same as the distance from the third printhead 24 to the second printhead 20. Under such ideal circumstances, as the receiver 12 traverses a path around the drum 14 each printhead begins printing at the same point on the images. Unfortunately, it is very difficult to space the printheads exactly equal distances from one another.

Figure 2:
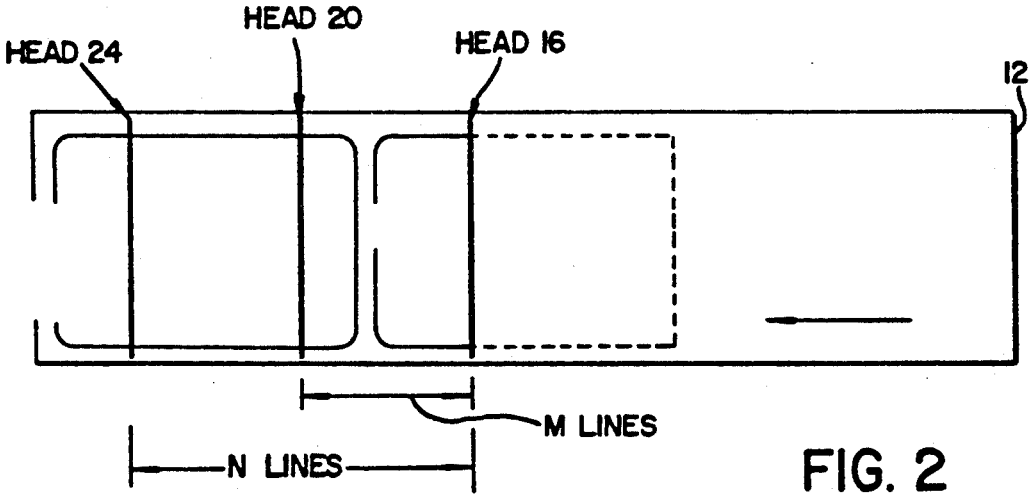
FIG. 2 is a diagrammatic view of the receiver web of FIG. 1 illustrating spacings between printheads.

Referring to FIGS. 1 and 2, the receiver web 12 traverses a path such that printhead 16 prints first on the receiver 12. That point or print line on the receiver 12 proceeds to the second printhead 20 for subsequent printing, and finally proceeds to the third printhead 24 for completion of the printing process. As illustrated, there are M lines between printhead 16 and printhead 20 and there are N lines between printhead 16 and printhead 24. When the first printhead 16 prints its first line, there are exactly M lines until the second printhead 20 prints its first line and there are exactly N lines until the third printhead 24 prints its first line.

Figure 3:
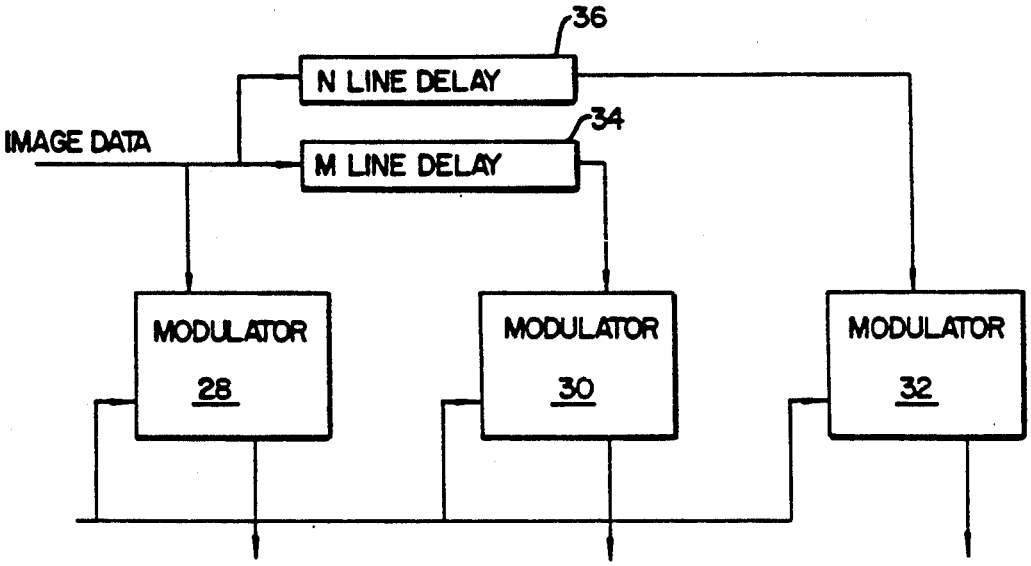
FIG. 3 is a block diagram illustrating line positioning by data delay to the nearest line.

Referring to FIG. 3, the print position along the print path taken by the receiver 12 is most easily adjusted by controlling the timing of the data to the printhead modulation circuitry which includes modulators 28, 30, 32. The modulator 28 receives image data and processes the image data for the first printhead 16. The modulator 28 typically processes a line of image data at a time, therefore, the smallest position adjustment possible in such a scheme is to the nearest line. Because the first modulator 28 processes the image data for the first printhead 16, it is used as the standard by which the second and third printheads 20, 24 align for printing.

Because there are M lines between the print start line for the first printhead 16 and the second printhead 20, an M line delay 34 is introduced to receive the image data prior to the image data reaching the second modulator 30 which processes the image data for the second printhead 20. Similarly, an N delay line 36 is introduced before the third modulator 32 to help process image data for the third printhead 24. More accurate position adjustment is possible if the start of line timing of each modulator circuit is controlled relative to the first printhead 16.

The position of the image produced by a thermal printhead along the print direction is determined by when data is sent to the printhead. By delaying the printing of a line by some fraction of a line time, the image can be proportionally repositioned by a fraction of a line.

Figure 4:
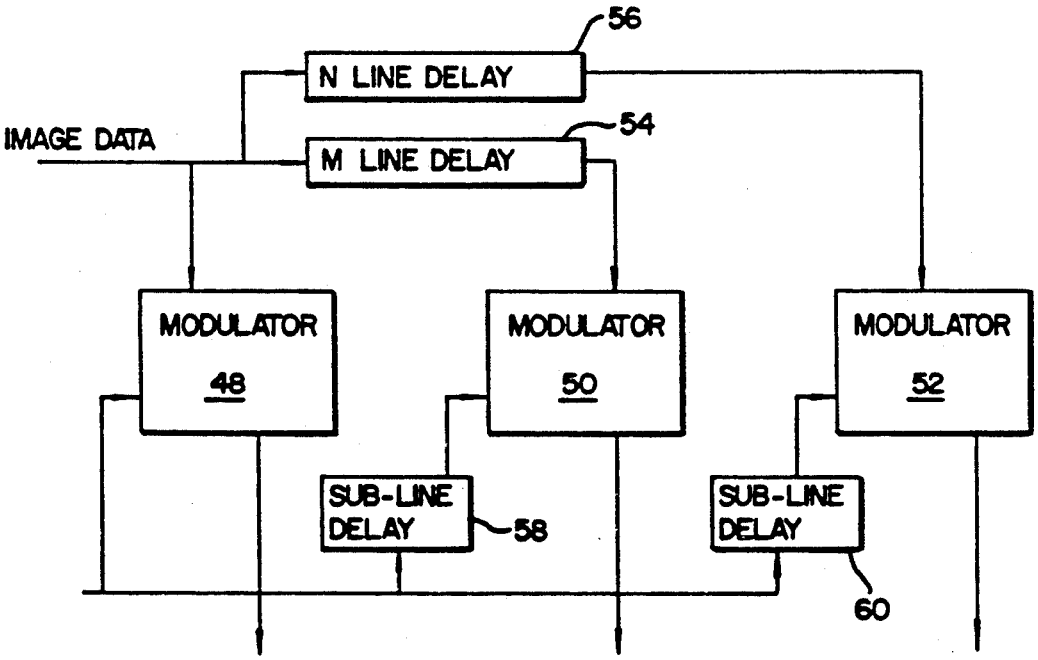
FIG. 4 is a block diagram illustrating line positioning by data delay with start line delay for position adjustment within a line.

Referring now to FIG. 4, a finer line adjustment is illustrated. The fine line adjustment is line positioning by data delay with start line delay for position adjustment within a line. The print position along the print path taken by the receiver 12 is most easily adjusted by controlling the timing of the data to the printhead modulation circuitry which includes modulators 48, 50 and 52. Modulator 48 receives image data and processes the image data for the first printhead 16. The modulator 48 typically processes a line of image data at a time, therefore, the smallest position adjustment possible is to the nearest line.

Because the first modulator 48 processes the image data for the first printhead 16, it is used as the standard by which the second and third printheads 50, 52 align their prints. Because there are M lines between the print start line for the first printhead 16 and the second printhead 20, an M line delay 54 is introduced to receive the image data prior to the image data reaching the second modulator 50 which processes the image data for the second printhead 20. Similarly, an N delay line 56 is introduced before the third modulator 52 to help process image data for the third printhead 24.

More accurate position adjustment is possible if the start of line timing of each modulator circuit is controlled relative to the first printhead 16. The position of the image produced by a thermal printhead along the print direction is determined by when data is sent to the printhead. By delaying the printing of a line by some fraction of a line time, the image can be proportionally shifted or repositioned by a fraction of a line. Sub-line delay 58 delays the printing of a line by some fraction of a line to proportionally reposition an image by a fraction of a line. Sub-line delay 58 influences modulator 50 which controls the second printhead 20. Thus, sub-line delay 58 works in conjunction with the M line delay circuitry 54 to properly position the receiver 12 relative to the second printhead 20.

Similarly, sub-line delay 60 influences modulator 52 which controls the third printhead 24. Sub-line delay 60 works in conjunction with the N line delay 56 to properly index the receiver 12 relative to the third printhead 24. A delay of data to position the images to the nearest line combined with a controllable delay for the start of modulation allows for more accurate positioning adjustment.

Referring now to FIGS. 5–9, a side to side adjustment of an image in the thermal printer 10 can easily be accomplished by shifting the image data to the printheads 16, 20, 24 by a required number of pixels. More precise fractional adjustments can be achieved by calculating a mid-pixel value based on the neighboring pixel values. A number of methods exist to calculate mid-pixel values such as interpolation.

Figure 8:
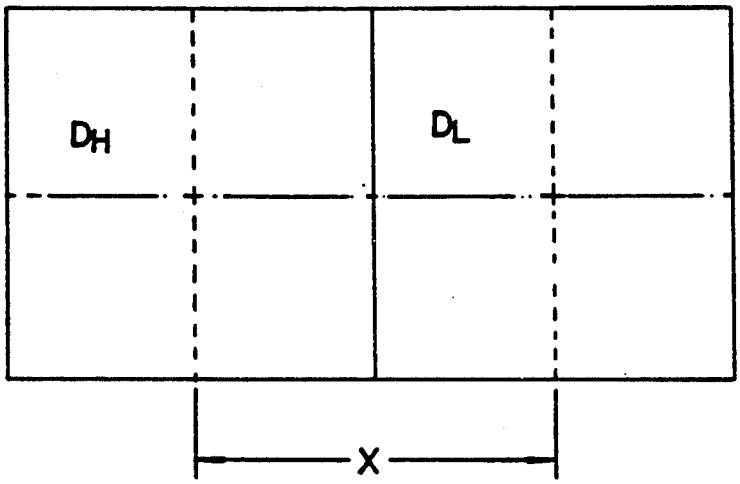
FIG. 8 is a somewhat enlarged view of adjacent pixels illustrating midpoint spacing.
Figure 9:
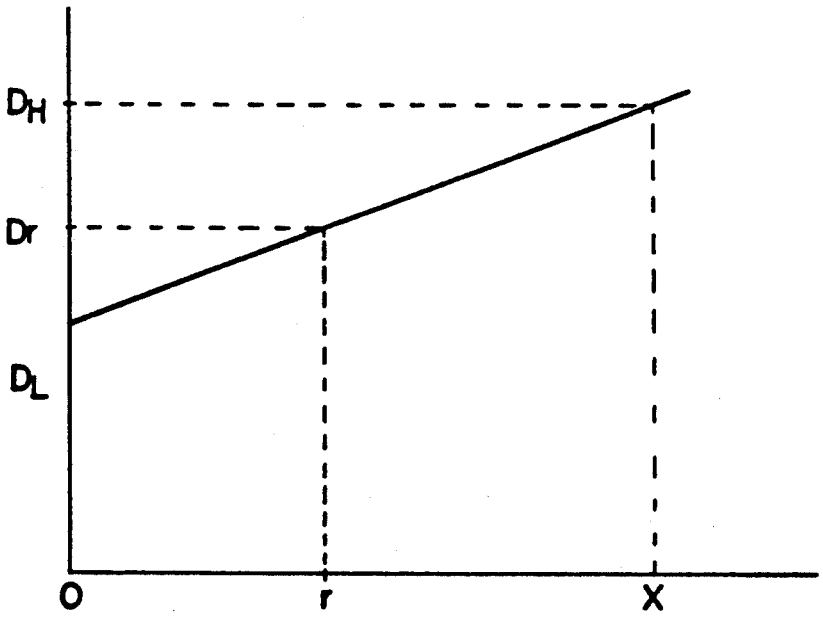
FIG. 9 is a graph illustrating varying pixel densities.

Interpolation is graphically illustrated in FIGS. 8–9 wherein density, $D_r$, at point r represents the boundary between adjacent pixels whose midpoints are separated by a distance, x. The density of the lower density pixel is $D_l$ and the density of the higher density pixel is $D_h$. The ratio of the distance r to the center to center spacing, x, of adjacent pixels is linearly proportional to the ratio of the density, $D_r$, at point r to the difference in densities, $D_h-D_l$, of the high density and low density pixels. This relationship expressed in a mathematical formula is $r/x = D_r/(D_h-D_l)$, so that $Dr=r/x(D_h-D_l)+D_l$. In the formula, the addition of $D_l$ compensates for the nonzero crossing of the line at the vertical axis.

Figure 5:
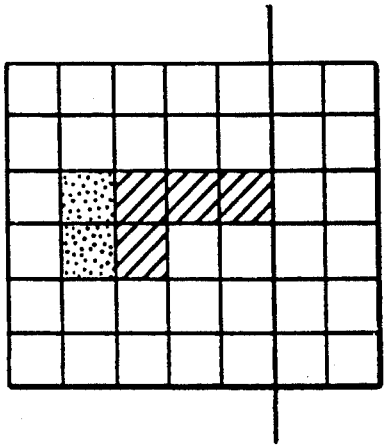
FIG. 5 is a diagrammatic view of the receiver web similar to FIG. 2, but illustrating the actual print position of an image area relative to a print line in the direction of travel of the web.
Figure 6:
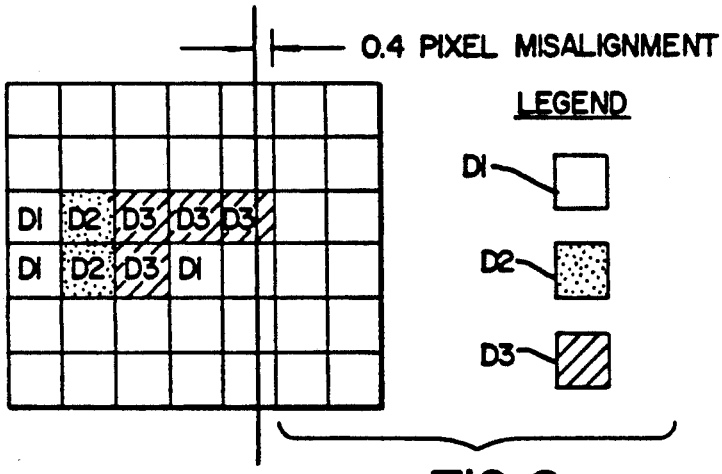
FIG. 6 is a diagrammatic view of the receiver web similar to FIG. 5, but illustrating the desired print position of an image area relative to a print line in the direction of travel of the web.

As is seen, the receiver 12 travels along the print path around the drum 14 wherein the image is printed by the first printhead 16 along the desired print line as illustrated in FIG. 5. FIG. 6, however, shows that the print position of the image is off approximately 0.4 pixels so that an adjustment is necessary to cause the second printhead 20 to align its print with that of the first printhead 16. FIG. 6 shows the density of desired pixels to be printed at various densities such as $D_1$, $D_2$ and $D_3$.

Figure 7:
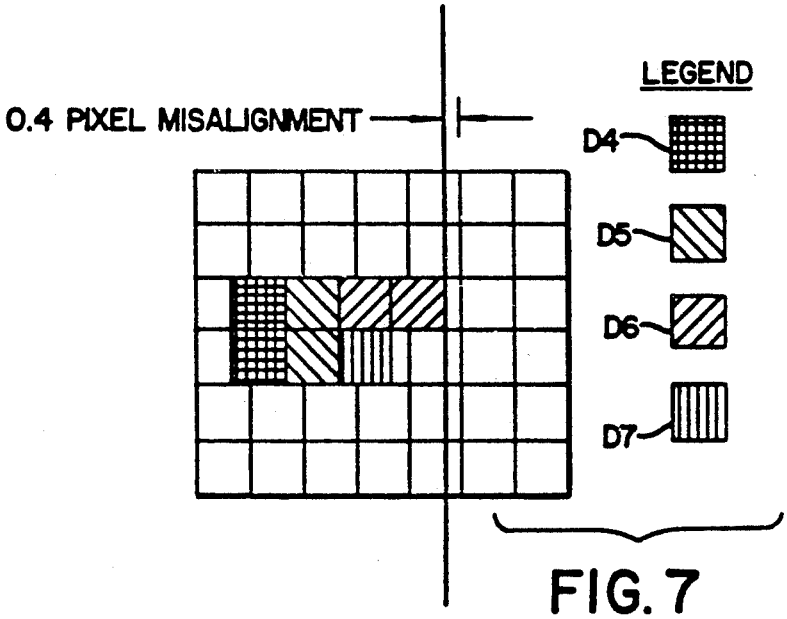
FIG. 7 is a diagrammatic view of the receiver web similar to FIGS. 5 and 6, but illustrating the shifted image area relative to a print line in the direction of travel of the web.

The adjustment is made in FIG. 7 where the print position is shifted by 0.4 pixels by the interpolation process. FIG. 7 shows the density of pixels actually printed by the second misaligned printhead 20 as densities $D_4$, $D_5$, $D_6$ and $D_7$. It can be seen that r/x from the interpolation formula above is 0.4 pixels. D4 is an interpolation of $D_1$ and $D_2$, so that:

$$D_4=0.4(D_1-D_2)+D_2,$$
$$D_5=0.4(D_2-D_3)+D_3,$$
$$D_6=0.4(D_3-D_3)+D_3, \text{ and}$$
$$D_7=0.4(D_3-D_1)+D_1.$$

Operation of the present invention is believed to be apparent from the foregoing description and drawings, but a few words will be added for emphasis. The first and second printheads are separated by M print lines while the first and third printheads are separated by N print lines. Print position along the print path is most easily adjusted by controlling the timing of the data to the printhead modulation circuitry. Because the modulator for each printhead typically processes a line of image data at a time, the smallest position adjustment possible is to the nearest line. More accurate position adjustment is obtained when the start of line timing of each modulator is controlled relative to the first printhead.

The position of the image produced by a thermal printhead along the print direction is determined by when data is sent to the printhead. The image can be proportionally repositioned by a fraction of a line by delaying the printing of a line by some fraction of a line time. Side to side adjustment of an image in a thermal printer is accomplished by shifting the data to the printhead by a required number of pixels. More precise fractional adjustments can be achieved by interpolation by calculating a mid-pixel value based on the neighboring pixel values.

It can now be appreciated that there has been presented a multiple printhead thermal printer which employs electronic print devices and circuitry to ensure exact registration between images from each printhead. The multiple printheads may print simultaneously, but the starting time for each head after the first printhead)is delayed by the amount of time required for the receiver to travel between printheads. The printheads may be placed at different points around a print drum or may be positioned along any path that guarantees a fixed spacing between the heads.

While the invention has been described with particular reference to a preferred embodiment, it will be understood by those skilled in the art that various changes may be made and equivalents may be substituted for elements of the preferred embodiment without departing from invention. In addition, many modifications may be made to adapt a particular situation and material to a teaching of the invention without departing from the essential teachings of the present invention.

With the present invention, the print position is adjusted electronically by controlling the timing of the data to the printhead modulation circuitry. The modulation circuitry processes a line of image data at a time with the smallest position adjustment being to the nearest line. By delaying the printing of a line by some fraction of a line time, the image can be proportionally repositioned by a fraction of a line. Sub-line delay circuits delay the printing of a line by some fraction of a line to proportionally reposition an image by a fraction of a line. Sub-line delay circuits influence the modulators which control the second printheads. A delay of data to position the images to the nearest line combined with a controllable delay for the start of modulation allows for more accurate positioning adjustment.

As is evident from the foregoing description, certain aspects of the invention are not limited to the particular details of the examples illustrated, and it is therefore contemplated that other modifications and applications will occur to those skilled in the art. For example, while the invention has been described with reference to linear interpolation to calculate mid-pixel values, four point interpolation may be used and other methods may also be used. Also, interpolation may be used with line delay for fine adjustment in both the longitudinal and lateral directions of the web. It is accordingly intended that the claims shall cover all such modifications and applications as do not depart from the true spirit and scope of the invention.

What is claimed is:

1. A thermal printer, comprising:

a dye receiver having a length;

a print platform supporting said receiver as dye is transferred to said receiver;

a first printhead having a dye bearing donor web and being associated with said print platform for controllably transferring dye to said receiver;

a second printhead having a dye baring donor web and being associated with said print platform a preselected distance from said first printhead for controllably transferring dye to said receiver;

a third printhead having a dye bearing donor web and being associated with said print platform a preselected distance from said first printhead for controllably transferring dye to said receiver; and means for effecting start of printing of each of said first, second and third printheads so that said first printhead begins printing at a preselected location along the length of said receiver, and, said second and third printheads each begin printing at said preselected location, said means including means for controlling side to side and sub-pixel registration.

2. A thermal printer, as set forth in claim 1, wherein said means for effecting start of printing further includes means for delaying printing of a line of image data by some fraction of a line tim.

3. A thermal printer, as set forth in claim 1, wherein said means for effecting a start of printing further includes means for providing a sub-line delay.

4. A thermal printer, as set forth in claim 1, wherein said means for effecting start of printing further includes interpolating between adjacent pixels.

5. A thermal printer, comprising:

a dye receiver positioned for travel in a direction;

a print drum supporting said receiver as dye in transferred to said receiver;

a first printhead having a dye bearing donor web and being associated with said print drum for controllably transferring dye to said receiver;

a second printhead having a dye bearing donor web and being positioned about said print drum a preselected distance from said first printhead for controllably transferring dye to said receiver; and means for providing a fraction of a line delay to control registration of multiframe images in the direction of travel of said receiver as said receiver travels between said first, second and third printheads, said means including means for controlling side to side and sub-pixel registration.

6. A thermal printer, as set forth in claim 5, wherein said means for providing delay further includes a sub-line delay.

7. A thermal printer, as set forth in claim 5, wherein said means for providing delay further includes interpolating between adjacent pixels.

8. A thermal printer, comprising:

a receiver having a width;

a print platform supporting said receiver as dye is transferred to said receiver;

a first printhead having a dye bearing donor web and being associated with said print platform for controllably transferring dye to said receiver;

a second printhead having a dye bearing donor web and being associated with said print platform a preselected distance from said first printhead for controllably transferring dye to said receiver; and means for laterally effecting start of printing of each of said first and second printheads so that said first printhead begins printing at a preselected location along the width of said receiver and said second printhead begins printing at said preselected location, said means including means for controlling side to side and sub-pixel registration.

9. A thermal printer, as set forth in claim 8, wherein said means for effecting start of printing further includes means for delaying printing of a line of image data by some fraction of a line time.

10. A thermal printer, as set forth in claim 9, wherein said means for effecting start of printing further includes means for providing a sub-line delay.

11. A thermal printer, as set forth in claim 8, wherein said means for effecting start of printing further includes means for interpolating between adjacent pixels.

12. A thermal printer, comprising:

a receiver having a width;

a print platform supporting said receiver as dye is transferred to said receiver;

a first printhead having a dye bearing donor web and being associated with said print platform for controllably transferring dye to said receiver;

a second printhead having a dye bearing donor web and being associated with said print platform a preselected distance from said first printhead for controllably transferring dye to said receiver;

means for laterally effecting start of printing of each of said first and second printheads so that said first printhead begins printing at a preselected location along the width of said receiver and said second printhead begins printing at said preselected location; and means for interpolating between adjacent pixels and controlling side to side sub-pixel registration.

13. A thermal printer, as set forth in claim 12, including means for interplating between adjacent pixels and determining a mid-pixel value.

14. A thermal printer, as set forth in claim 12, including means for interpolating between adjacent pixels and determining a mid-pixel density.

15. A thermal printer, comprising:

a receiver having a width;

a print platform supporting said receiver as dye is transferred to said receiver;

a first printhead having a dye bearing donor web and being associated with said print platform for controllably transferring dye to said receiver;

a second printhead having a dye bearing donor web and being associated with said print platform a preselected distance from said first printhead for controllably transferring dye to said receiver;

means for laterally effecting start of printing of each of said first and second printheads so that said first printhead begins printing at a preselected location along the width of said receiver and said second printhead begins printing at said preselected location; and means for determining a mod-pixel density using a formula $$D_r = \frac{r}{x(D_h - D_l)} + D_l,$$

wherein Dr is density at point r, r represents a boundary between adjacent pixels whose mid-points are separated by a distance x, and $D_h$ and $D_l$ are densities of higher and lower density pixels, respectfully.

* * * * *

UNITED STATES PATENT AND TRADEMARK OFFICE

CERTIFICATE OF CORRECTION

PATENT NO. : 5,196,864

DATED : March 23, 1993

INVENTOR(S) : Holden R. Caine

It is certified that error appears in the above-indentified patent and that said Letters Patent is hereby corrected as shown below:

Col. 6, Claim 1, line 34, after "dye" delete "baring" and insert --bearing--.

Col. 6, Claim 2, line 53, after "line" delete "tim" and insert --time--.

Col. 6, Claim 3, line 55, after "effecting" delete "a".

Col. 6, Claim 5, line 62, after "dye" delete "in" and insert --is--.

Signed and Sealed this

Third Day of May, 1994

*Attest:*

Bruce Lehman

BRUCE LEHMAN

*Attesting Officer*

*Commissioner of Patents and Trademarks*